US005899241A

United States Patent [19]

David et al.

[11] Patent Number: 5,899,241

[45] Date of Patent: May 4, 1999

[54] LINKED MULTILAYER FABRIC FOR STRUCTURAL COMPOSITE MATERIALS

[75] Inventors: Laurent Jean Pierre David, Saint Germain les Corbeil; Jean Pierre Marie Dessinges, Cublizes; François Billaut, Paris, all of France

[73] Assignees: Societe Nationale D'Etude et de Construction de Moteurs D'Aviation "Snecma", Paris; Societe Cotton Textiles Pour Materiaux Innovants "CTMI", La Sone, both of France

[21] Appl. No.: 09/018,176

[22] Filed: Feb. 3, 1998

[30] Foreign Application Priority Data

Feb. 4, 1997 [FR] France ..... 97.01200

[51] Int. Cl.[6] ..... D03D 11/00; D03D 13/00

[52] U.S. Cl. ..... 139/408; 422/207

[58] Field of Search ..... 139/383 A, 408, 139/DIG. 1; 442/207

[56] References Cited

U.S. PATENT DOCUMENTS

| | | | |
|---|---|---|---|
| 20,267 | 5/1858 | Gujer | 139/408 |
| 1,750,498 | 3/1930 | Spencer | 139/383 A |
| 2,949,134 | 8/1960 | Hindle et al. | 139/383 A |
| 4,174,739 | 11/1979 | Rasero et al. . | |
| 4,312,913 | 1/1982 | Rheaume | 139/408 |
| 4,922,969 | 5/1990 | Campman et al. . | |
| 5,050,646 | 9/1991 | Fry | 139/383 A |
| 5,104,726 | 4/1992 | Ross | 139/408 |
| 5,456,974 | 10/1995 | Lundblad et al. | 139/408 |
| 5,713,397 | 2/1998 | Lee | 139/383 A |

FOREIGN PATENT DOCUMENTS

| | | |
|---|---|---|
| 0570318 A1 | 11/1893 | European Pat. Off. . |
| 0439274 A1 | 7/1991 | European Pat. Off. . |
| 2610951 A1 | 8/1988 | France . |

*Primary Examiner*—Andy Falik

*Attorney, Agent, or Firm*—Oblon, Spivak, McClelland, Maier & Neustadt, P.C.

[57] ABSTRACT

A linked multilayer woven fabric for use in the production of structural composite materials has a base weave comprising twenty-eight weft yarns which are distributed in eight columns containing alternately four superimposed yarns and three superimposed yarns such that they are in a staggered arrangement on seven levels, and twelve warp yarns which are arranged in four parallel planes each containing three superimposed parallel warp yarns. In each plane, one of the warp yarns connects the upper outermost weft yarn of one of the weft columns containing four weft yarns to the corresponding weft yarn of the following base weave group via the upper intermediate weft yarn of the weft column midway between the other two columns, a second of the warp yarns connects the upper intermediate weft yarn of said one column to the corresponding weft yarn of the following base weave group via the lower intermediate weft yarn of said midway column, and the third warp yarn connects the lower intermediate weft yarn of said one column to the corresponding weft yarn of the following base weave group via the lower outermost weft yarn of said midway column.

1 Claim, 2 Drawing Sheets

LINKED MULTILAYER FABRIC FOR STRUCTURAL COMPOSITE MATERIALS

BACKGROUND OF THE INVENTION

1. Field of the Invention

The present invention relates to an optimized textile weave, of the linked multilayer type, which can be used in the production of composite material components which are highly stressed and/or subjected to impacts. By way of example, such components include wide-chord fan blades for civil aircraft engines, structural casing arms for civil or military aircraft engines, and self-stiffened aircraft panels or leading edges.

The subject of the invention is therefore a woven fibrous fabric, constituting a textile preform for the production of such components, which may be preimpregnated by means of liquid, for example using the "RTM" (Resin Transfer Moulding) injection process, or by means of gas. For this purpose, the textile preform must satisfy a number of criteria or conditions:

- the use of fibres which have very high mechanical performance characteristics but which a priori are brittle during weaving, such as high-modulus carbon fibres;
- the use of carbon fibres having an unusual and high linear density, for example consisting of 48 or 96 kilofilaments, or even more;
- the optimum degree of interlinking in the thickness direction of the fabric;
- the possibility of producing composite materials having a high volume fraction filled by fibres, in particular a fraction of greater than 57% for structural composite materials;
- linearity of the weft yarns in the fabric;
- a low linkage angle (in particular less than 15°) between the warp yarns and the weft yarns and the possibility of unbalanced weaving so as to compensate for the non-linearity of the warp yarns and to adjust the properties in the plane of the fabric, (for example, with a proportion of 70% warp yarns and 30% weft yarns);
- the possibility of reversing the unbalanced weaving (by rotating the weave through 90°) so as to improve the linearity; and
- the formation of a linked fabric which is highly deformable.

2. Summary of the Prior Art

So-called "1D" and "2D" textile structures, depending on whether their fibres extend in a single direction or in two different directions, do not satisfy the abovementioned constraints. So-called "3D" multilayer structures (having fibres arranged along three directions in space) may approach, at least partly, the desired objectives in the field of application of the invention. However, with regard to multilayer structures having more than three fibre directions ("4D", "5D", "9D", "11D", these cannot be exploited on an industrial scale because of the extreme complexity of their production using automatable processes.

Thus, we shall look in more detail at multilayer structures of the "3D" type.

Among these structures, stitch-linked "3D" multilayer fabrics are known which fully meet the linearity of the warp yarns and which have the advantage of including reinforcing yarns at other angles. However, this method of linking does not make it possible to impart good impact resistance to the composite materials obtained.

Also known are "3D" multilayer fabrics linked by weaving, the orthogonal "3D" fabric being the weave which has the best linearity of warp and weft yarns and which resists compression well. However, in order for this fabric to provide the desired volume fraction of fibres, the "3D" fabric must be compressed in such a way that the yarns arranged along the third direction, which are corrugated rather than linear, do not contribute to load transfer.

Although "non-orthogonal 3D" multilayer fabrics are more suitable, they have the drawback of having linkage angles which are too high, this being the case for simple weaves of the multilayer taffeta, multilayer satin or multilayer twill type, and also more elaborate weaves, such as that known by the name "3X".

The particular fabric of the "non-orthogonal 3D" type, also known as "2.5D", described in FR-A-2,610,951 is the weave known hitherto to be the most optimized, having a low expansion and a high percentage of surface occupied, but with a low linearity. However, the restrictive definition of this fabric gives it angular characteristics prejudicial to the impact strength and limits the reversible textile definitions (by rotation of the weave through 90°) to constructions of low density, unless a high number of additional layers is added, which is prejudicial to industrial automation.

SUMMARY OF THE INVENTION

It is an object of the present invention to remedy these drawbacks and to provide a novel fabric which has all the desirable properties envisaged earlier, while optimizing its load transfer properties and the compressive strength, and which is practical to manufacture using known industrial weaving techniques and/or techniques which are readily adaptable by those skilled in the art.

To this end, the invention provides a linked multilayer fabric for structural composite materials, having a base weave comprising at least twenty-eight weft yarns and at least twelve warp yarns, said weft yarns being arranged in at least eight columns extending in the direction of the thickness of said fabric and wherein columns containing at least four weft yarns disposed one above another are separated from each other by a predetermined spacing and alternate with columns which contain at least three weft yarns disposed one above another and which are separated from each other by the same said predetermined spacing, the weft yarns of said columns containing at least three weft yarns being staggered with respect to the weft yarns of said columns containing at least four weft yarns such that said weft yarns are arranged on at least seven levels, and said at least twelve warp yarns being arranged in at least four parallel planes, each plane containing at least three parallel warp yarns disposed one above another such that:

- a first of said at least three parallel warp yarns connects the upper outermost weft yarn of one of said columns containing at least four weft yarns to an upper intermediate weft yarn of a second column of at least four weft yarns spaced from said one column by at least twice said predetermined spacing, and returns to the upper outermost weft yarn of a column containing at least four weft yarns spaced from said one column by at least four times said predetermined spacing;
- a second of said at least three parallel warp yarns connects an upper intermediate weft yarn of said one column to a lower intermediate weft yarn of said second column, and returns to an upper intermediate weft yarn of said column of at least four weft yarns which is spaced from said one column by at least four times said predetermined spacing; and
- a third of said at least three parallel warp yarns connects a lower intermediate weft yarn of said one column to the lower outermost weft yarn of said second column, and returns to a lower intermediate weft yarn of said column of at least four weft yarns which is spaced from said one column by at least four times said predetermined spacing;

the corresponding positions of said at least three parallel warp yarns in adjacent planes being longitudinally offset from each other by said predetermined spacing.

This arrangement gives a multilayer structure having a high degree of linkage, which provides a surprising improvement in the resistance to delamination and hence a greater impact strength, while maintaining sufficient deformability for the envisaged applications, the staggered interlacing of the weft yarns making it possible, for a given construction, to reduce the linkage angle of the warp yarns and to avoid angular peculiarities in these yarns.

The invention will be perhaps more clearly understood from the following description of a preferred embodiment of the fabric in accordance with the invention, with reference to the appended diagrammatic drawings.

DESCRIPTION OF THE PREFERRED EMBODIMENT

Figure 1:
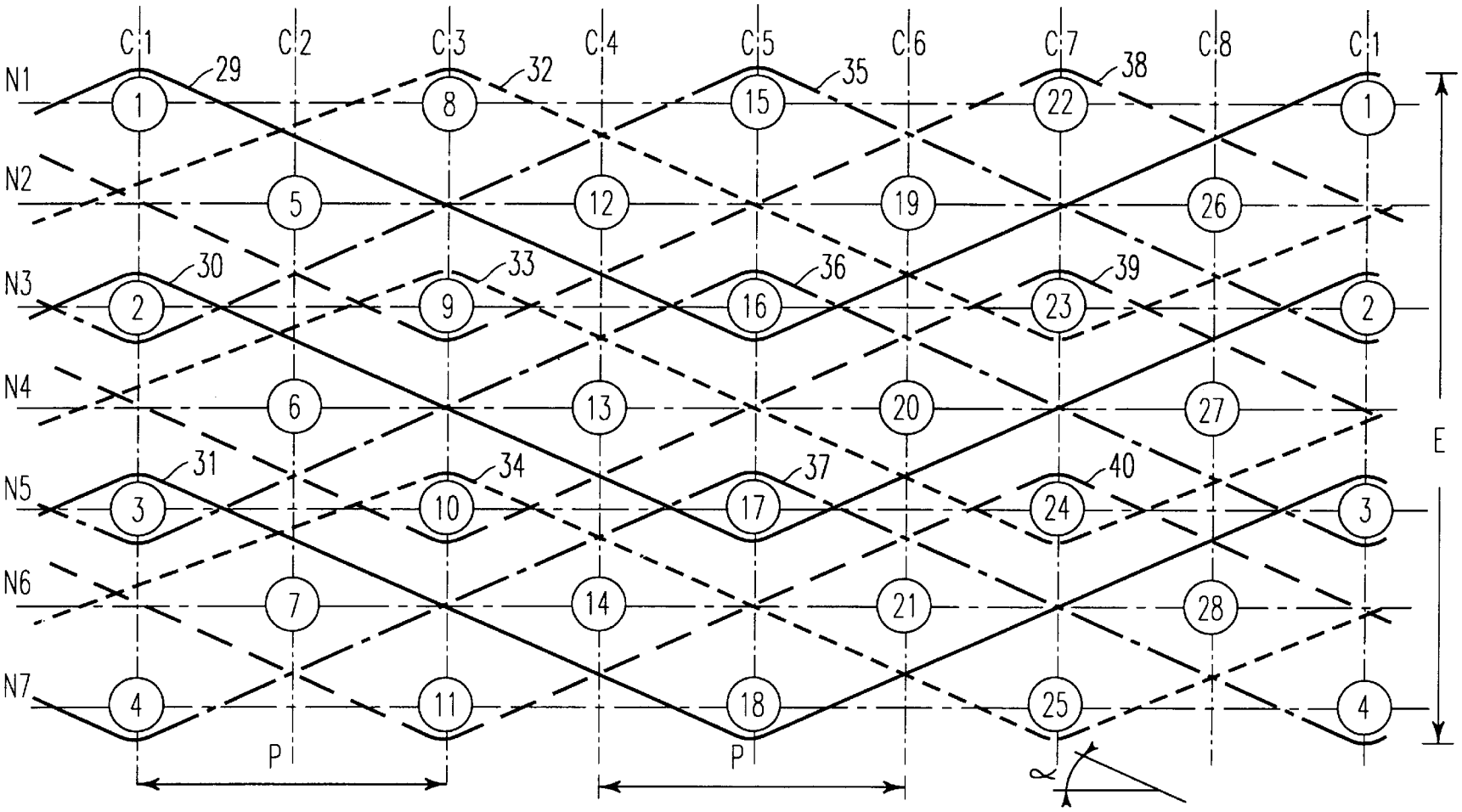
FIG. 1 is a diagrammatic cross-sectional view of a portion of a linked multilayer woven fabric in accordance with one embodiment of the present invention, illustrating the overall base weave pattern of the fabric.
Figure 2:
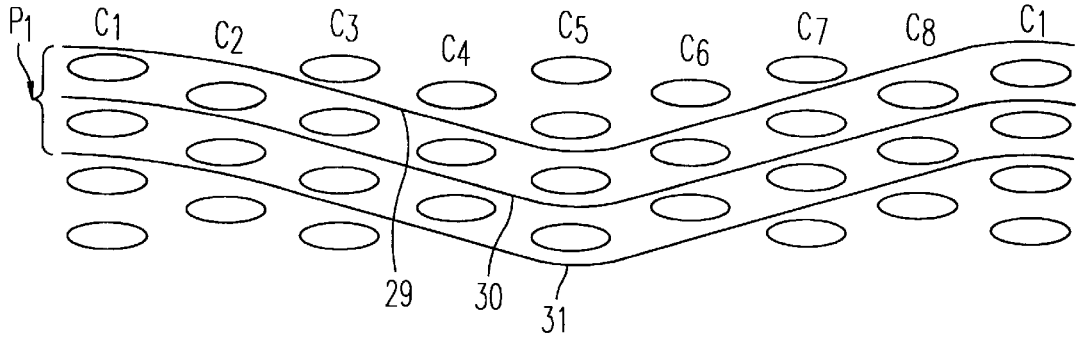
FIG. 2 is a diagrammatic sectional view of the base weave pattern shown in FIG. 1, but showing only the warp yarns contained in a first longitudinal vertical plane of the fabric.
Figure 3:
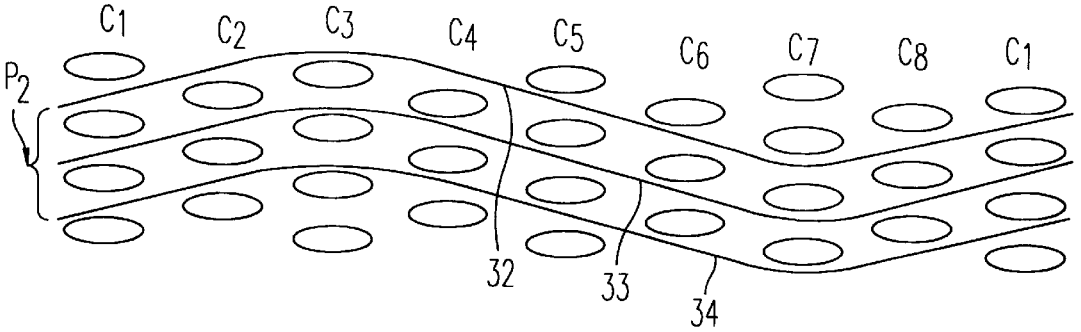
FIG. 3 is a view similar to FIG. 2, but showing only the warp yarns contained in a second plane.
Figure 4:
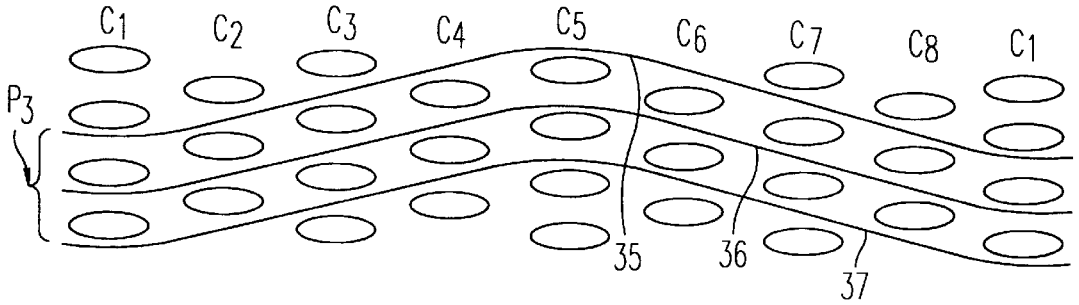
FIG. 4 is a view similar to FIG. 2, but showing only the warp yarns contained in a third plane.
Figure 5:
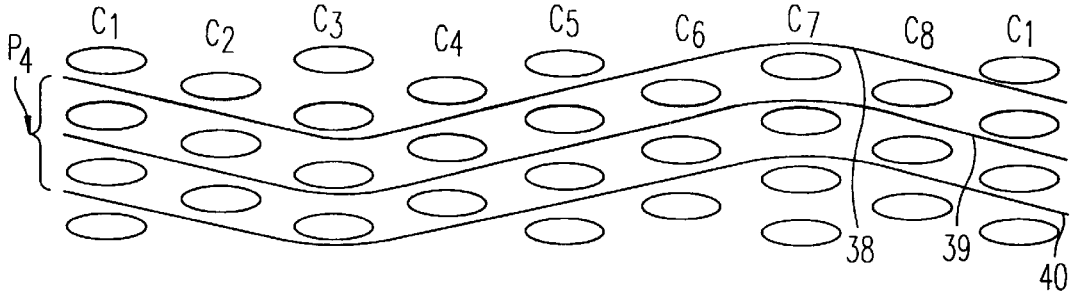
FIG. 5 is a view similar to FIG. 2, but showing only the warp yarns contained in a fourth plane.

The figures illustrate the base weave structure in one embodiment of a fabric in accordance with the present invention. This base weave structure comprises twenty-eight weft yarns 1–28 which are arranged in a staggered configuration on seven successive levels N1 to N7 and are distributed in eight columns C1 to C8, namely:

a first column C1 of four weft yarns 1, 2, 3, 4 which are located one above another at levels N1, N3, N5, N7;

a second column C2 of three weft yarns 5, 6, 7 which are located one above another at levels N2, N4, N6;

a third column C3 of four weft yarns 8, 9, 10, 11 which are located one above another at levels N1, N3, N5, N7;

a fourth column C4 of three weft yarns 12, 13, 14 which are located one above another at levels N2, N4, N6;

a fifth column C5 of four weft yarns 15, 16, 17, 18 which are located one above another at levels N1, N3, N5, N7;

a sixth column C6 of three weft yarns 19, 20, 21 which are located one above another at levels N2, N4, N6; a seventh column C7 of four weft yarns 22, 23, 24, 25 which are located one above another at levels N1, N3, N5, N7; and an eighth column C8 of three weft yarns 26, 27, 28 which are located one above another at levels N2, N4, N6.

The columns C1, C3, CS, C7 containing four superimposed weft yarns are separated from one another by regular intervals representing a predetermined spacing P, and this same spacing P separates the columns C2, C4, C6, C8 which contain three superimposed weft yarns and which alternate with the columns C1, C3, C5, C7. The arrangement of weft yarns as just described obviously repeats itself along the longitudinal direction of the fabric (i.e. the direction of the warp yarns).

The weft yarns 1 to 28 are linked together by warp yarns, of which there are twelve in the base weave structure arranged in four parallel longitudinal vertical planes P1, P2, P3, P4. FIG. 1 shows diagrammatically all the warp yarns of the base weave, whereas FIGS. 2 to 5 show separately, for the sake of clarity, the warp yarns of the different planes P1 to P4. Each of these planes contains three parallel warp yarns disposed one above another as follows.

In the first plane P1 (FIG. 2), a first warp yarn 29 connects the upper outermost weft yarn 1 of column C1 to the upper intermediate weft yarn 16 of column CS and returns over the upper outermost weft yarn 1 in column C1 of the following group of twenty-eight weft yarns. A second warp yarn 30 connects the upper intermediate weft yarn 2 of column C1 to the lower intermediate weft yarn 17 of column CS and returns over the upper intermediate weft yarn 2 in column 1 of the following group. A third warp yarn 31 connects the lower intermediate weft yarn 3 of column C1 to the lower outermost weft yarn 18 of column C5 and returns over the lower intermediate weft yarn 3 in column 1 of the following group.

In the second plane P2 (FIG. 3), a first warp yarn 32 connects the upper outermost weft yarn 8 of column C3 to the upper intermediate weft yarn 23 of column C7 and returns over the upper outermost weft yarn 8 in column C3 of the following group. A second warp yarn 33 connects the upper intermediate weft yarn 9 of column C3 to the lower intermediate weft yarn 24 of column C7 and returns over the upper intermediate weft yarn 9 in column C3 of the following group. A third warp yarn 34 connects the lower intermediate weft yarn 10 of column C3 to the lower outermost weft yarn 25 of column C7 and returns over the lower intermediate weft yarn 10 in column C3 of the following group.

In the third plane P3 (FIG. 4), a first warp yarn 35 connects the upper outermost weft yarn 15 of column C5 to the upper intermediate weft yarn 2 in column C1 of the following group and returns over the upper outermost weft yarn 15 in column C5 of the following group. A second warp yarn 36 connects the upper intermediate weft yarn 16 of column C5 to the lower intermediate weft yarn 3 in column C1 of the following group and returns over the upper intermediate weft yarn 16 in column C5 of the following group. A third warp yarn 37 connects the lower intermediate weft yarn 17 of column C5 to the lower outermost weft yarn 4 in column C1 of the following group and returns over the lower intermediate weft yarn 17 in column C5 of the following group.

Finally, in the fourth plane P4 (FIG. 5), a first warp yarn 38 connects the upper outermost weft yarn 22 of column C7 to the upper intermediate weft yarn 9 in column C3 of the following group and returns over the upper outermost weft yarn 22 in column C7 of the following group. A second warp yarn 39 connects the upper intermediate weft yarn 23 of column C7 to the lower intermediate weft yarn 10 in column C3 of the following group and returns over the upper intermediate weft yarn 23 in column C7 of the following group. A third and final warp yarn 40 connects the lower intermediate weft yarn 24 of column C7 to the lower outermost weft yarn 11 in column C3 of the following group and returns over the lower intermediate weft yarn 23 in column C7 of the following group.

It will be noted that the same configuration of three parallel warp yarns is longitudinally shifted, from one plane to next, by the value of the spacing P defined earlier.

Of course, this warp configuration of the base weave, defined over four planes, will be repeated indefinitely in the transverse direction (i.e. the direction of the weft yarns) to form fabric sheets.

Thus, a linked multilayer woven fabric is obtained which may be indefinitely extended both longitudinally and transversely by repetition of the same base weave pattern.

By way of example, a material having this fabric structure may be made from high-strength carbon fibres having a density of 1.81, with seven levels of weft yarns, as shown in the drawing, which, after densification using the aforementioned "RTM" process, has a thickness E of 7 mm, while the value of the spacing P is equal to 10.9 mm (corresponding to a weft density of 91.5 yarns/m), the average linkage angle $\alpha$ of the warp yarns being 10.4°. The volume fraction of fibres is 60% and the percentage of warp yarns (with respect to the weft yarns) is 70%. The total surface density of the fabric is 7602 g/m$^2$, the weft surface density being 2280 g/m$^2$ (distributed in seven weft levels, i.e. 326 g/m$^2$ per weft level). This carbon fibre fabric has intrinsically the following mechanical properties:

E=290 GPa $\sigma$=5000 MPa, and makes it possible to obtain, using a high-performance epoxy resin, a composite material having the following mechanical properties:

$E_{warp}$ (in tension)>100 GPa $E_{weft}$ (in tension)>60 GPa $\sigma_{warp}$ (in tension)>1000 MPa $\sigma_{warp}$ (in compression)>500 MPa $\sigma_{weft}$ (in tension)>800 MPa $\sigma_{weft}$ (in compression)>400 MPa Toughness ($G_{1c}$)>2500 J/m$^2$ The latter value of 2500 J/m$^2$, representing the propagation energy, may be compared with the following values obtained for corresponding materials made using fabrics belonging to the prior art:

1000 J/m$^2$ for an "orthogonal 3D" structure

1500 J/m$^2$ for a "3X" structure

2500 J/m$^2$ for a "2.5D" structure.

It should be noted, however, that the compressive strength of the "2.5D" structure is 300 MPa, compared with the value of 500 MPa obtained using the fabric of the invention.

The linked multilayer fabric forming the subject of the invention is particularly suitable for use in the production of a composite wide-chord fan blade for an aircraft engine.

It goes without saying that the invention is not limited to the single embodiment of the linked multilayer fabric which has been described above by way of example, but embraces all alternative embodiments and applications thereof which embody the same principle. In particular, the base weave described above may be supplemented, in the thickness direction, by the addition of pairs of weft-yarn levels and, in the longitudinal direction, by the addition of columns of weft yarns, without departing from the principle of the invention. Within the same context, the fabric may be produced not only from carbon fibres but also from glass fibres, aramid fibres, silica fibres or ceramic fibres. Also, the linked multilayer fabric is not limited in its applications to fan blades or other aircraft engine components. Finally, the linked multilayer fabric forming the subject of the present invention may be converted using any other suitable technique instead of the "RTM" process in order to achieve the structural composite materials which can eventually be obtained from the fabric.

We claim:

1. A linked multilayer fabric for structural composite materials, having a base weave comprising at least twenty eight weft yarns and at least twelve warp yarns, said weft yarns being arranged in at least eight columns extending in the direction of the thickness of said fabric and wherein columns containing at least four weft yarns disposed one above another are separated from each other by a predetermined spacing and alternate with columns which contain at least three weft yarns disposed one above another and which are separated from each other by the same said predetermined spacing, the weft yarns of said columns containing at least three weft yarns being staggered with respect to the weft yarns of said columns containing at least four weft yarns such that said weft yarns are arranged on at least seven levels, and said at least twelve warp yarns being arranged in at least four parallel planes, each plane containing at least three parallel warp yarns disposed one above another such that:

a first of said at least three parallel warp yarns connects the upper outermost weft yarn of one of said columns containing at least four weft yarns to an upper intermediate weft yarn of a second column of at least four weft yarns spaced from said one column by at least twice said predetermined spacing, and returns to the upper outermost weft yarn of a column containing at least four weft yarns spaced from said one column by at least four times said predetermined spacing;

a second of said at least three parallel warp yarns connects an upper intermediate weft yarn of said one column to a lower intermediate weft yarn of said second column, and returns to an upper intermediate weft yarn of said column of at least four weft yarns which is spaced from said one column by at least four times said predetermined spacing; and a third of said at least three parallel warp yarns connects a lower intermediate weft yarn of said one column to the lower outermost weft yarn of said second column, and returns to a lower intermediate weft yarn of said column of at least four weft yarns which is spaced from said one column by at least four times said predetermined spacing;

the corresponding positions of said at least three parallel warp yarns in adjacent planes being longitudinally offset from each other by said predetermined spacing.

* * * * *